United States Patent [19]

Browse

[11] 4,234,152

[45] Nov. 18, 1980

[54] SEATS FOR CHILDREN

[75] Inventor: Edward Browse, Burwell, England

[73] Assignee: Inventec Licensing BV, De Leersum, Netherlands

[21] Appl. No.: 10,614

[22] Filed: Feb. 9, 1979

[30] Foreign Application Priority Data

Feb. 10, 1978 [GB] United Kingdom ..... 5502/78

[51] Int. Cl.[3] ..... F16M 11/00; A47C 1/02; A63G 31/00

[52] U.S. Cl. ..... 248/415; 248/406; 272/1 R; 297/349

[58] Field of Search ..... 272/1 R, 33; 297/348, 297/349; 248/406, 405, 415; 46/64, 73, 68, 71

[56] References Cited

U.S. PATENT DOCUMENTS

| | | | |
|---|---|---|---|
| 134,423 | 12/1872 | Doremus | 297/348 |
| 159,243 | 1/1975 | Woodward | 248/406 |
| 629,382 | 7/1899 | MacKenzie | 46/68 |
| 968,565 | 8/1910 | Hunn | 248/415 X |
| 1,671,403 | 5/1928 | Brown . | |
| 2,501,976 | 3/1950 | Vitek | 297/348 |
| 2,584,015 | 1/1952 | Hawes | 248/405 X |
| 3,534,937 | 10/1970 | Heinzel | 248/406 X |
| 3,583,092 | 6/1971 | Schoenfield | 46/68 X |
| 3,730,520 | 5/1973 | Willis | 272/1 R |
| 4,026,509 | 5/1977 | Wolters | 248/406 |

FOREIGN PATENT DOCUMENTS 1041809 9/1966 United Kingdom .

*Primary Examiner*—James T. McCall
*Attorney, Agent, or Firm*—Brumbaugh, Graves, Donohue & Raymond

[57] ABSTRACT

A child's seat includes a base structure having a central helical screw. A seat is mounted on a shaft for upward movement without rotation. Thereafter, the seat can only fall while rotating due to engagement of teeth respectively on a nut and on the shaft. After reaching its lowermost position, the nut is disengaged from the shaft to permit free rotation of the seat in either direction.

12 Claims, 8 Drawing Figures

SEATS FOR CHILDREN

BACKGROUND OF THE INVENTION

1. Field of the Invention

The present invention relates to seats for children, and more specifically, to seats which provide a source of amusement for children as well as simply providing something to sit upon.

2. Description of the Prior Art

Chairs which include a rotary seat structure mounted on a stationary base structure are well known, particularly in the office furniture field. These chairs sometimes have the facility of being raised or lowered upon rotation of the seat structure but not simply as a result of sitting still on the seat structure. Rather they are normally quite stable at any set height. U.S. Pat. No. 4,026,509 (Wolters) illustrates one example of the above type of office chair. Specifically, this specification discloses a supporting spindle for a chair which can be shifted from a mode in which the height of the seat is adjusted by rotation of the seat while the seat is unoccupied to a mode in which the seat can be rotated in either direction without effecting any change in vertical position when the seat is occupied. The change in mode is effected by the release of a lock when the spindle is downwardly telescoped against the bias of a spring by the weight of the seat's occupant.

SUMMARY OF THE INVENTION

It is an object of the present invention to provide a child's seat which is capable of providing amusement. It includes a seat structure which can be raised and then, under the weight of the child, rotated as it is lowered.

Specifically, according to the invention, a seat comprises a base structure, and a seat structure, a connection between the seat structure and the base structure which allows the seat structure to be raised relative to the base structure, and then, under the influence of the user's weight on the seat structure, to fall again relative to the base structure while rotating about a vertical axis.

In one convenient arrangement, the connection between the base structure and the seat structure includes a vertically arranged coarse-pitch screw, to convert the falling movement of the seat structure into a rotary movement. The pitch of the screw is so chosen that friction is not capable of preventing the descent of the seat structure under a child's weight, but is able to control the speed of rotation to a reasonable value of, say, not more than one revolution per second. The screw may have a pitch of, for example, one inch.

The seat may be used in various ways to provide amusement. For example, after manually raising the seat structure, a child can either sit, stand, lie prone, or lie supine on the seat structure, which will then descend and rotate. After reaching its lowest position, further rotation of the seat structure may be possible, and this may be produced by the inertia of the seat structure, or by the child pushing with its feet against the base structure or the adjacent ground.

The connection between the seat structure and the base structure may be so arranged that the manual lifting of the seat structure can be accomplished without any rotary movement thereof. Where a screw is used to produce the rotary movement accompanying the downward seat structure movement, the seat conveniently includes a nut or analogous device which is so arranged that it is able to rotate independently of the seat structure on raising of the seat structure, but is constrained to rotate with the seat structure during the descending movement of the seat structure. Preferably, when the seat structure reaches its lowest position, free rotation of the seat structure in either direction should be possible; this can be achieved by providing a bearing which receives the weight of the seat structure in its lowest position, so that the nut is not loaded, and by so arranging the nut that it is only constrained to rotate with the seat structure when weight is being carried by the nut. Such an arrangement would allow the seat structure to continue to rotate under its own inertia when the falling movement has been completed.

According to another aspect of the present invention, a child's seat comprises a base structure, a vertically extending spiral surface mounted on the base structure, the spiral surface having a vertically extending open space therewithin, a shaft extending vertically and mounted for vertical reciprocation within said open space, the shaft having an upper portion, a seat structure mounted on said upper portion, the shaft having a lower end portion, a cam follower member mounted on said lower end portion, said cam follower member being arranged to co-operate with said spiral surface, at least upon downward movement of the shaft and seat structure under the weight of a child thereon, to cause rotation of the shaft and seat structure. Specifically, the lower end portion of the shaft may be of reduced diameter and the cam follower member may be mounted for limited axial movement on said lower end portion between raised and lowered positions, the upper end of said cam follower member having a first toothed surface for engagement with a second toothed surface on the shaft, said first and second toothed surfaces being engaged in the raised position of the cam follower member to transmit rotary movement of the cam follower member to the shaft, the cam follower member being arranged to move to its lowered position, when the shaft completes its downward movement, thereby to disengage said first and second toothed surfaces and permit continued rotation of the shaft.

DETAILED DESCRIPTION OF THE SPECIFIC EMBODIMENTS

Figure 6:
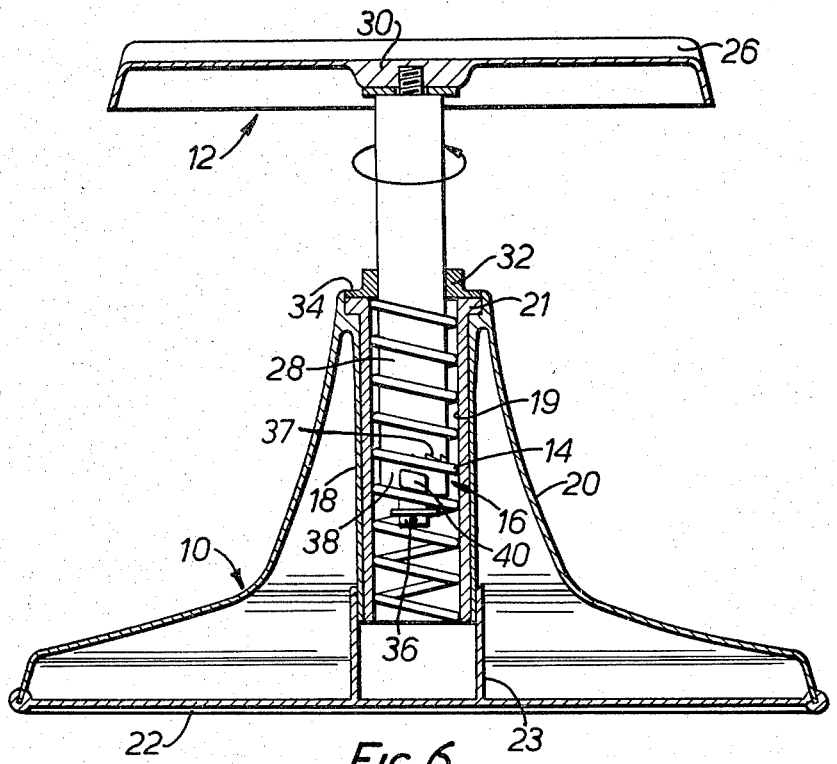
FIG. 6 is a sectional view of the embodiment of FIG. 1, showing the parts thereof as they would appear when the seat is descending.
Figure 7:
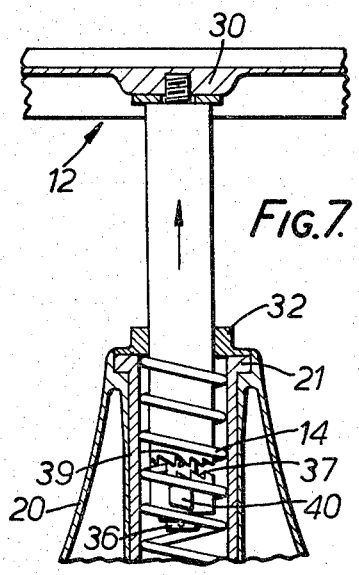
FIG. 7 is a partial sectional view of the embodiment of FIG. 1, showing the parts thereof as they would appear as the seat is being raised.
Figure 8:
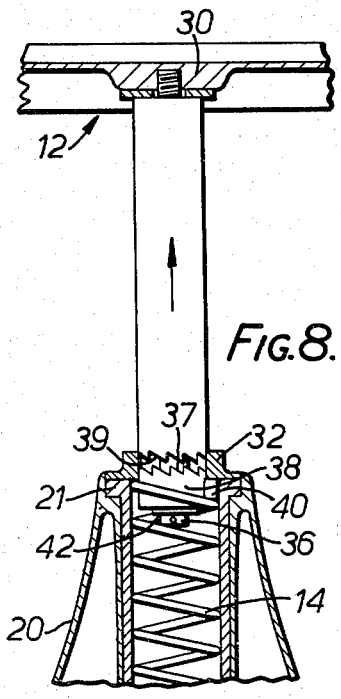
FIG. 8 is a partial sectional view similar to FIG. 7, but showing the seat parts in the fully raised position.

The child's seat shown in the drawings comprises a base structure 10 and a seat structure 12. In the position shown in FIG. 1, the seat structure is in its lowest position relative to the base structure, about 10 inches above the floor, and can rotate freely in either direction without any vertical movement. The seat structure 12 can also be manually lifted by about 6 inches from this lowest position; (as illustrated in FIGS. 7 and 8) if the child then applies its weight to the seat, the seat structure descends again, with the descent being accompanied by rotation of the seat structure 12 (as illustrated in FIG. 6). This rotation is induced by a coarse-pitch screw 14, the pitch of the screw being about one inch. The screw 14 co-operates with a nut arrangement 16 which is so arranged that it allows the free rotation of the seat structure 12 which is mentioned above, and also allows the seat structure 12 to be lifted manually, as mentioned above. It will be appreciated that this arrangement also allows the seat structure to continue to rotate by its own inertia once it has descended from its raised position.

The construction of the seat will now be described in greater detail.

The base structure 10 comprises a hollow plastics moulding affording a circular base, and a central column portion 20. A tubular portion 18 extends downwards from the top of the column portion 20, within the base moulding, and receives a metallic sleeve 19 having a flange 21 at its upper end. The screw 14 takes the form of a round steel bar which is wound into a helical shape, and is pressed into the sleeve 19, the top end of the screw is then secured in place by means not shown. The underside of the base moulding is closed by a plastics cover 22, which has a lip fitting around the outer periphery of the circular base, and also has a sleeve 23 which receives the lower end of the tubular portion 18.

The seat structure 12 comprises a seat pan 26 which is also a plastics moulding, and incoporates a thickened portion 30 by which it is secured to the top end of a shaft 28. The shaft 28 is guided for rotation and vertical sliding movement in a bearing bush 32, which is integral with a flange 34 of the base structure 10 which is secured to the flange 21 by screws not shown. The shaft 28 is therefore maintained coaxial with, and extends down into the free central space of the screw 14. At its bottom end, the shaft 28 carries the nut arrangement 16. Thus, the bottom end of the shaft 28 has a reduced diameter portion 36, on which is mounted a sleeve 38 having a single laterally projecting portion 40. The sleeve 38 is axially slidable on the reduced portion 36, but is kept captive by a circlip 42 fitted to the end of the portion 36. The sleeve 38 is also rotatable on the reduced portion 36, but its upper end is provided with face teeth 37 (shown as ratchet teeth, although this is not essential), while the shoulder at the upper end of the reduced portion 36 is provided with complementary face teeth 39, so that rotation of the sleeve 38 relative to the shaft 28 is not possible when the sleeve 38 is at its highest position along the reduced portion 36 (as shown in FIG. 6). The lateral projection 40 is long enough in the radial direction to engage the top surface or the bottom surface, as the case may be, of the bar which forms the screw 14 (also as shown in FIG. 6). Thus when the seat structure 12 is in the raised position, the weight on the seat structure can be transferred, through the shaft 28, the sleeve 38 and the projection 40 to the base structure 10. Under these conditions, the face teeth 37, 39 on the sleeve 38 and the shaft 28 are in engagement (see FIG. 6). The weight on the seat structure produces a downwards movement of the seat structure, which is accompanied by a rotation of the sleeve 38, because of the engagement between the screw 14 and the projection 40, and this rotation is transmitted to the shaft 28 and the seat pan 26 by the interengagement between the face teeth 37, 39 (see FIG. 6).

The downward movement of the seat structure continues in this manner until the underside of the thickened portion 30 abuts against the top of the bearing bush 32 (in fact, a plastics thrust washer is provided between these two parts). When this happens, the downward movement of the seat structure is arrested, and the weight of the seat structure is now transmitted to the base structure through the bush 32 rather than through the sleeve 38. Further rotation of the seat structure allows the sleeve 38 to continue its downward movement slightly further under its own weight, and this results in disengagement of the face teeth 37, 39 so that the shaft 28 is now free to rotate independently of the sleeve 38, in either direction.

Figure 1:
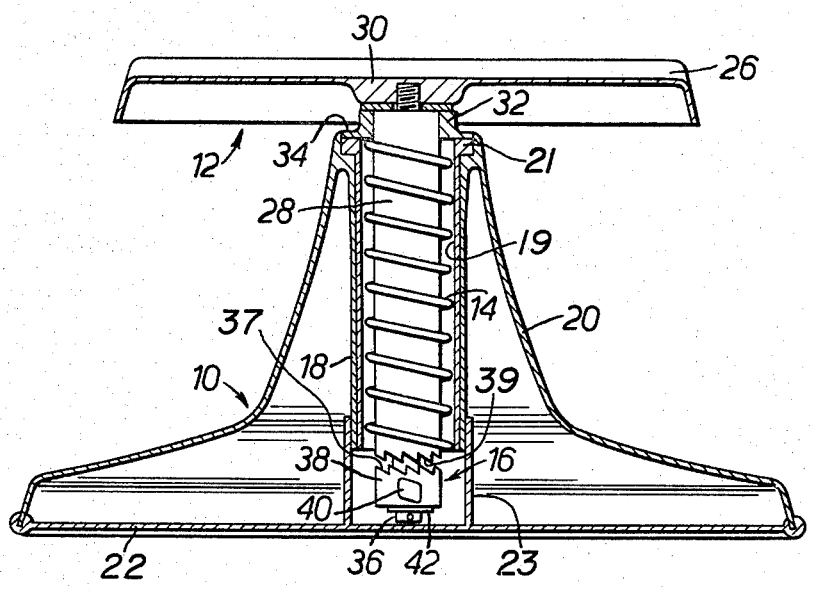
FIG. 1 is a section view taken on a vertical plane, through a child's seat embodying the present invention.
Figure 2:
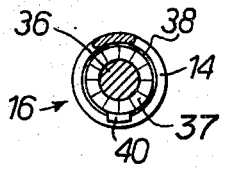
FIG. 2 is a partial horizontal sectional view, showing a screw and nut arrangement which forms part of the seat as they would appear when the seat is raised and the projection on the nut rests on the upper surface of the screw.
Figure 3:
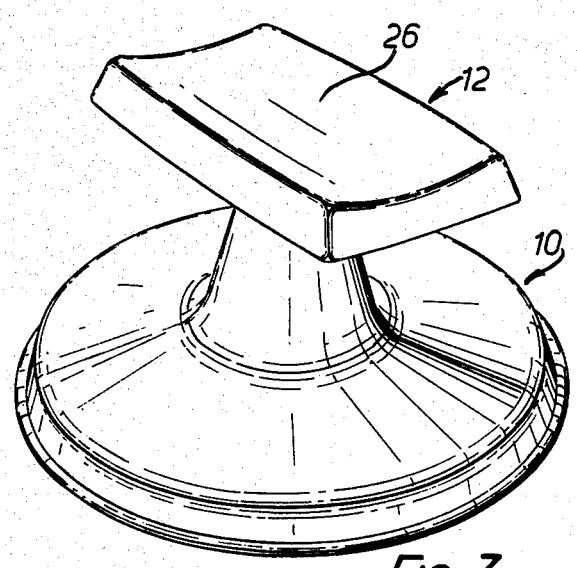
FIG. 3 is a perspective view of the seat.

When the seat structure 12 is lifted, the sleeve 38 travels upwards again, and is forced to rotate by engagement of the projection 40 with the bottom side of the screw 14, but since the weight of the sleeve 38 keeps it in its lowest position on the reduced portion 36, resting on the circlip 42, there is no engagement of the face teeth 37, 39, and the rotation of the sleeve 38 is not transmitted to the shaft 28 (as shown in FIG. 6). Upward movement of the seat structure is limited by the engagement of the projection 40 against the underside of the bush 32 so that the seat structure and base structure cannot be separated (as shown in FIG. 8). As shown in FIG. 1, the top and bottom sides of the projection 40 are inclined to match the pitch of the screw 14 to facilitate travel of the projection along the screw, in the nature of a cam follower, in either direction.

Various modifications are possible. For example, the shaft 28 might be rigidly connected to the projection 40, but be connected to the seat pan 26 by a connection which allows engagement and disengagement in the same way as the face teeth on the sleeve 38. Although the face teeth are illustrated as being fairly fine, giving closely-spaced positions of engagement, there could in fact be only, say, one or two dog teeth to provide the engagement.

Figure 4:
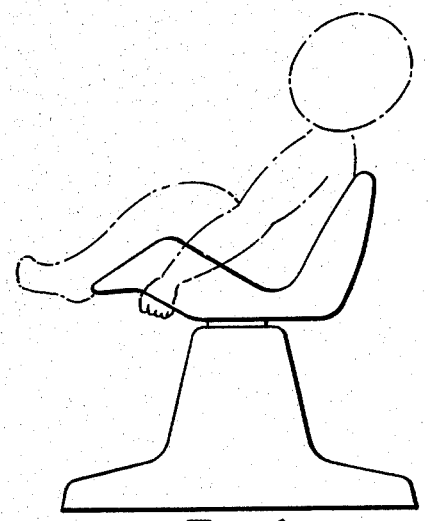
FIGS. 4 and 5 are views showing two alternative forms of the seat.
Figure 5:
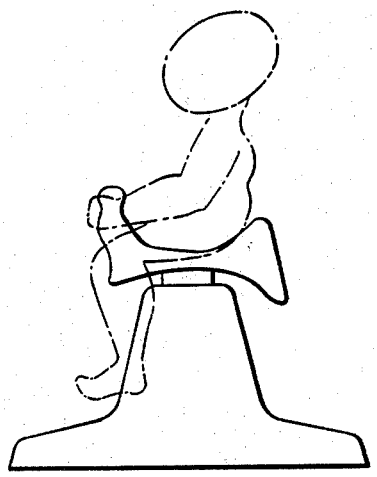

One or more hand-holds could be provided in the base moulding, to facilitate carrying, and an anchor could be provided to retain the seat structure in its lowest position when the seat is being carried. Other forms of seat pan could also be used. For example, FIG. 4 illustrates a seat pan which resembles the seat of a vehicle such as a car or spacecraft, whilst FIG. 5 illustrates a seat pan which resembles a saddle, in this case a Western saddle.

It might be possible to arrange that the seat pan 26 makes a tilting, rocking or nodding movement as it descends. Whilst the construction shown is manually raised, it could alternatively be returned to its raised condition by a spring.

What I claim as may invention and desire to secure by Letters Patent is:

1. A portable child's amusement seat having a base structure, a seat structure, and means for supporting the seat structure on the base structure in overlying relation thereto, wherein the improvement in said supporting means comprises:

a first member connected to the underside of said seat structure and extending vertically downward therefrom towards said base structure; and co-acting means carried in part by said first member and in part by said base structure for supporting said seat structure over said base structure such that said seat structure can be raised and lowered relative to said base structure and for causing, in response to the user's weight and/or to the weight of the seat structure, said seat structure to move downwardly and to rotate relative to the said base structure about a vertical axis extending through said seat structure.

2. A seat as claimed in claim 1 in which said co-acting means includes means defining a vertically arranged coarse-pitch screw on one of said first member and said base structure and means on the other of said first member and said base structure for engaging said screw during at least downward movement of said seat structure for converting the downward movement of the seat structure into a rotary movement.

3. A seat as claimed in claim 1 in which said co-acting means includes means for permitting the seat structure to be raised without any rotary movement thereof.

4. A seat as claimed in claim 2 in which said screw-engaging means comprises a cam follower member arranged to travel along said screw upon upward and downward movement of the seat structure, and means for mounting said follower member on said other member for rotation independently of the seat structure on upward movement of the seat structure and for rotation with the seat structure in load-transmitting relation to said screw-defining means during downward movement of the seat structure.

5. A seat as claimed in claim 4 in which said co-acting means permits the seat structure to continue to rotate under its own inertia when the downward movement has been completed.

6. A seat as claimed in claim 4 in which said follower member mounting means permits free rotation of the seat structure in either direction after the seat structure has reached the lowest position thereof relative to said base structure.

7. A seat as claimed in claim 6 in which said co-acting means includes a bearing which receives the weight of the seat structure when said seat structure is in said lowest position, whereby said follower member is not loaded, and said follower member mounting means constrains said follower member for rotation with the seat structure only when said weight is being carried by the follower member.

8. A seat as claimed in claim 2, in which said screw-defining means comprises a spiral bar located in a vertically upwardly extending tubular member carried by said base structure, said first member extending vertically downwardly within said tubular member, and said co-acting means includes a follower member carried by said first member for co-acting with said spiral bar upon downward movement of said seat structure for causing said rotation of said seat structure.

9. A portable child's amusement seat comprising a base structure, a vertically extending spiral surface mounted on the base structure, the spiral surface having a vertically extending open space therewithin, a shaft extending vertically and mounted for vertical reciprocation within said open space, a seat structure mounted on the upper end of said shaft in overlying relation thereto, a cam follower mounted on the lower end of said shaft, said cam follower member being arranged to travel along said spiral surface, at least upon downward movement of the shaft and seat structure under the weight of the child thereon, to cause rotation of the shaft and the seat structure.

10. A seat as claimed in claim 9 in which said lower end portion of the shaft is of reduced diameter, the cam follower member being mounted for limited axial movement on said lower end portion between upper and lower positions, the upper end of said cam follower member having a first toothed surface for engagement with a second toothed surface on the shaft, said first and second toothed surfaces being engaged in the upper position of the cam follower member to transmit rotary movement of the cam follower member to the shaft, the cam follower member being arranged to move to its lower position, when the shaft has completed its downward movement relative to the spiral surface, thereby to disengage said first and second toothed surfaces and permit continued independent rotation of the shaft.

11. A seat as claimed in claim 4 in which said coarse-pitch screw is carried by said base structure and said first member extends vertically within said screw, said follower member being mounted by said mounting means on the lower end of said first member for limited vertical movement relative thereto between upper and lower positions, said follower member mounting means including co-operating teeth on said follower member and on said first member, said teeth being in engagement for joint rotation of said follower member and said first member when said follower member is in said upper position, and being out of engagement for independent rotation of said follower member relative to said first member when said follower member is in said lower position.

12. A seat as claimed in claim 1, wherein the improvement in said supporting means further comprises:

a second member carried by said base structure and extending upwards therefrom towards said seat structure, one of said first and second members being telescopically and co-axially received within the other member such that said axis of rotation comprises the common axis of said first and second members; and the part of said co-acting means carried by said base structure comprises said second member.

* * * * *